US005842456A

United States Patent [19]

Morganti

[11] Patent Number: 5,842,456

[45] Date of Patent: Dec. 1, 1998

[54] PROGRAMMED MULTI-FIRING AND DUTY CYCLING FOR A COIL-ON-PLUG IGNITION SYSTEM WITH KNOCK DETECTION

[75] Inventor: Carl R. Morganti, Farmington Hills, Mich.

[73] Assignee: Chrysler Corporation, Highland Park, Mich.

[21] Appl. No.: 380,275

[22] Filed: Jan. 30, 1995

[51] Int. Cl.[6] ..... F02P 3/06

[52] U.S. Cl. ..... 123/606; 123/618; 123/636; 123/425; 123/426

[58] Field of Search ..... 123/606, 618, 123/636, 425, 426, 607, 608, 612, 634, 635, 604

[56] References Cited

U.S. PATENT DOCUMENTS

| | | | |
|---|---|---|---|
| 4,418,660 | 12/1983 | Endo et al. | 123/606 |
| 4,787,360 | 11/1988 | Filippone | 123/606 |
| 5,056,496 | 10/1991 | Morino et al. | 123/604 |
| 5,097,815 | 3/1992 | Oota et al. | 123/606 |
| 5,179,928 | 1/1993 | Cour et al. | 123/606 |

*Primary Examiner*—Raymond A. Nelli

*Attorney, Agent, or Firm*—Mark P. Calcaterra

[57] ABSTRACT

An ignition system for multi-firing a spark plug of a spark ignition internal combustion engine and for detecting auto-ignition utilizing the spark plug as a feedback element. The ignition system includes a pulse transformer connected to a spark plug, a distribution element coupled to the transformer, a timing element connected to the distribution element, a controller, an engine position sensor and a spark discharge detection circuit. Based on engine parameters, the controller loads the timing element with the appropriate signals and triggers one of three timers. The triggered timer begins to count down and times-out at the appropriate engine position either ignition or simply for auto-ignition. This triggers a second timer which enables yet another timer that provides control signals to the distribution element to produce a series of voltage signals of a predetermined magnitude applied by the transformer at the spark plug. These control signals are continuously provided until the second timer times-out ending that cycle of the system. If auto-ignition is occurring in the combustion cylinder, at least one of the voltage signals applied at the spark plug will discharge. The discharge circuit will sense the discharge and provide a signal to the controller indicating auto-ignition thereby allowing the controller to respond accordingly.

20 Claims, 3 Drawing Sheets

PROGRAMMED MULTI-FIRING AND DUTY CYCLING FOR A COIL-ON-PLUG IGNITION SYSTEM WITH KNOCK DETECTION

BACKGROUND OF THE INVENTION

The present invention generally relates to a coil-on-plug automotive ignition system for an internal combustion engine. More particularly, this invention relates to pulsed programmed multi-firing of a capacitive discharge coil-on-plug ignition system and to programmed duty cycling for the detection of auto-ignition within the engine.

In order to initiate combustion of an air/fuel mixture within an internal combustion engine, the spark ignition system is used to generate a high current arc at the appropriate time in the engine operating cycle. The onset of the arc across the spark plug gap is timed to occur at a predetermined number of degrees of engine shaft rotation, usually before the piston reaches top dead center (TDC).

If the spark timing is properly established, the flame front or kernal emanating from the spark plug will cause a pressure increase to develop within the combustion chamber. This pressure will peak just after TDC of the piston, during the piston's power stroke. If the spark is initiated too late in the operating cycle (retarded timing), the pressure developed within the combustion chamber is not efficiently converted into work output. On the other hand, if the spark is initiated too early in the operating cycle (advanced timing), extremely high and potentially damaging pressures and temperatures can result. These pressure and temperature rises resulting from advanced timing are also not efficiently converted into useful work output.

Excessive advanced timing can also lead to several other types of combustion chamber phenomena. As mentioned above, auto-ignition of the end gases is a condition where the end gases (the unburnt portion of the fuel-air mixture initially ignited by the movement of the flame front) explode spontaneously as a result of the cylinder temperature and pressure becoming too high. When auto-ignition occurs in the cylinder, the cylinder pressure fluctuates alternately rising and falling in response to the sudden release of energy and the resulting pressure wave traveling back and forth across the combustion cylinder. In addition to the pressure fluctuation, the temperature also dramatically increases. When caused by auto-ignition of the end gases, the rapid pressure and temperature fluctuations will be seen to occur well after top dead center. If the rate of energy released by auto-ignition is high enough, the exploding gases will cause the cylinder walls to vibrate, resulting in audible engine noises including the distinctive sound often referred to as "pinging".

Many engine developers believe that a mild degree of auto-ignition is desirable because it generates turbulence within the cylinder which, in turn, hastens the combustion process at a time when the speed of the flame emanating from the spark plug is decreasing. Slight auto-ignition has also been found to reduce emissions by reducing the amount of unburnt hydrocarbons left by the spark-triggered ignition process. By simultaneously utilizing the energy released when these hydrocarbons are burned, in addition to lower hydrocarbon emissions, improved fuel economy can be realized as well.

For the above reasons, engine designers often seek to calibrate ignition systems so that spark advance is close to the threshold of auto-ignition. Care must be taken, however, to avoid excessive auto-ignition which is counter productive and can lead to high combustion chamber temperatures that can further heat the spark plug electrodes to the point where they initiate the combustion process independently of the spark. This resulting phenomena is known as pre-ignition.

Pre-ignition is marked by extremely high cylinder temperatures and pressures near TDC and can cause significant engine damage such as perforation of the piston itself. Pre-ignition is frequently referred to as "knock" because of the characteristic audible sound which it produces. Generally, it can be stated that auto-ignition leads to pre-ignition, and, subsequently, that pre-ignition leads to further auto-ignition.

A number of factors influence the timing threshold for generating auto-ignition. These factors include inlet air temperature, engine speed, engine load, air/fuel ratio, fuel characteristics, and a host of other variables. Spark timing also directly affects fuel efficiency and the amount of noxious emissions which are produced. Because of the significance in accurately controlling the spark timing, numerous engine control systems have been developed which use a microprocessor based closed-loop spark timing control system. These systems simultaneously measure a number of parameters, such as exhaust composition, coolant temperature, and the occurrence of spark knock. The resulting data is then processed to set the engine timing near a predicted auto-ignition threshold.

Knock detectors presently used with spark control systems are typically piezoelectric transducers which sense the intense vibration caused by spark knock. These knock detectors, however, are not sensitive enough to detect incipient engine auto-ignition which may barely produce a vibration detectable over normal engine vibration. For this reason, the threshold of auto-ignition is not sensed by such transducers. Accordingly, there is a need to provide a spark ignition control system which enables the detection of incipient auto-ignition, thus enabling more precision in setting spark timing in a closed-loop system.

A coil-on-plug ignition system for use in an automotive internal combustion engine, such as that found in a motor vehicle, is described in U.S. Pat. No. 4,846,129, issued to Noble (hereinafter the Noble patent) and commonly assigned to the Assignee of the present application, which is hereby incorporated by reference. The Noble patent discloses a coil-on-plug ignition system that can be used to monitor auto-ignition in the engine cylinder. That system includes an onboard ignition controller or microprocessor which receives input signals from various engine sensors including engine timing transducers, an engine timing controller and oxygen sensor modules. The microprocessor provides output signals which energize the spark plugs through a DC/DC converter, drivers and pulse transformers, the latter two being mounted directly on the spark plugs.

To detect auto-ignition of the end gases in the Noble patent, a controller microprocessor receives engine timing signals and provides output signals based thereon to pulse transformers which apply a "hover" voltage or series of voltage pulses to the spark plug during the time at which auto-ignition is likely to occur. If auto-ignition is occurring, the low pressure variations in the cylinder will allow the hover voltage to trigger a spark across the plug gap. A sensor circuit senses the discharge of the applied voltage and reports the discharge to the controller. In response, the controller successively steps down the timing until auto-ignition ceases. If normal combustion is occurring in the cylinder, no spark will be triggered in response to the applied voltage.

SUMMARY OF THE INVENTION

The present invention details a coil-on-plug circuit and the associated software scheme for the control of a coil-on-plug automotive ignition system with knock detection. The present invention augments the capabilities of the microprocessor unit (MPU) used in on-board engine controllers, making it possible for the MPU to detect and control incipient auto-ignition.

Some of the new and useful features presented by the present invention include: 1) The concept of programmed multi-firing of a capacitive discharge ignition system during a combustion cycle. Previous multi-firing ignition systems have relied upon a natural resonance within the ignition circuitry or a fixed countdown counter to retrigger the firing. This disclosure, however, is believed to detail the first ignition system designed to multi-fire based on algorithms programmed into the engine controller itself. Multi-firing is programmed to occur only under hard-to-ignite mixture conditions such as throttle tip-ins, cold starts, idle and at combinations of light loads and low rpms. By not multi-firing under other conditions, an extension in the life of the ignition components is realized, especially in the spark plug electrode. 2) The ignition coil is duty-cycled, based on a programmed algorithm, for knock detection. 3) A coil-on-plug control circuit which provides for the programmed firing of multiple ignition coils (i.e., coil-on-plug ignition pulse transformers), the programmed multi-firing of the ignition coils for initiation of the combustion process and the programmed duty-cycling of the ignition coils for knock detection.

Recent combustion research has indicated that combustion within the internal combustion engine could be improved by initiating the burning process with a spark of the type known as a breakdown discharge. This type of spark has characteristics quite different from those generated by conventional automotive ignition systems. Benefits include more stable combustion, lower emissions, and an extension of the lean limit. Other benefits are believed to include extended catalytic converter life, extended spark plug electrode life and ability to fire fouled spark plugs.

The inventors have found that an ignition system with a DC/DC converter and individual pulse transformer coil at each spark plug offers the best configuration to generate spark discharges with the desired characteristics. Because of the short duration of the spark, this configuration also makes rapid, multi-firings of the spark plugs possible. Typically, prototypes have been found to be capable of refiring spark plugs at 100 microsecond intervals. These tests have also shown that multi-firing the spark plug during a combustion event is beneficial to the combustion process under hard to ignite conditions, provided the refirings all occur with approximately 500 microseconds of the initial firing. Apparently, plug refirings occurring after this time window are too late to enhance development of the flame kernal.

A new concept for controlling and initiating the firing of the spark plug for ignition and for knock detection has also been developed. This concept requires the ignition coil driver to be duty cycled rapidly for 200 to 400 $\mu$s during that portion of the combustion process where knock is expected to occur. While the required duty cycle can be determined by an "interrogator pulse" as explained in the aforementioned Noble patent, the present invention discloses an alternative system where the duty-cycle can be calculated from an algorithm programmed in the memory of the engine controller. The algorithm calculates duty-cycle as a function of various parameters including manifold pressure, engine speed, and charge temperature. Once calculated and the circuit initialized, the controller is not required to control firing sequence and is freed for other purposes.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENT

Figure 1:
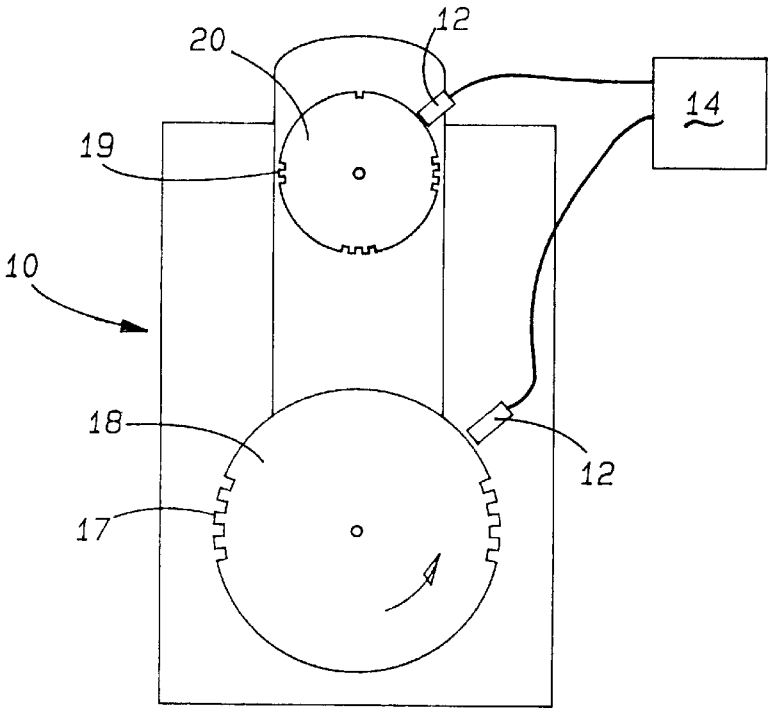
FIG. 1 is a schematic illustration of an engine having timing pick-ups as used in conjunction with the present invention.

Referring now to the drawings, an MPU 16, as found in a typical on-board engine controller 14, spends most of its time executing a main program loop which performs functions that are relatively non-critical from an engine timing standpoint. The rate at which these functions must be repeated is also relatively slow in comparison to the engine cycle itself. This generally means that these functions can be performed asynchronously from the engine combustion events.

Injection and ignition events, however, must be synchronized to the engine cycle. In accomplishing this, the MPU 16 services interrupts that are triggered by a timing pick-up 12 (usually mounted relative to the flywheel 18) on the engine 10. FIG. 1 shows an end view of a four cylinder engine with its synchronizing and timing pick-ups 12.

The interrupts produced by the pick-ups 12 load a timing element 26 of the MPU 16. The timing element 26 creates real-time, control signals for the fuel injectors and ignition coil drivers 30 at the correct instant and for the correct duration during the combustion cycle.

Previously, to create repetitive signals for multi-firing coil drivers 30 at 100 microsecond intervals, an additional interrupt would have to be serviced for each refiring of the spark plug or the coil drivers 30. This, however, would result in excessive interrupt loading of the MPU 16 and would create interrupt timing conflicts. When excessive interrupt loading occurs, the main program loop would be interrupted at too high a frequency during too great a percentage of its execution time and/or such that too many interrupts would be nested within one another. Interrupt timing conflicts would result in the MP 16 being required to service more than one interrupt at a time in order to generate the required control signals. The MP 16, however, can only execute one interrupt at a time.

In duty cycling the signal required for knock detection, the duty cycling period is approximately 20 microseconds and continues for a duration of about 200–400 microseconds. Most MP's require at least 20 microseconds just to prepare for and service one interrupt. Therefore, the only way the MP 16 can directly generate the duty cycling signal for knock detection is to handle all the required signals as one single interrupt enduring for the entire 200–400 microsecond interval. This, however, would represent an unacceptable amount of time taken away from the execution of the main program loop, especially for those engine applications having more than four cylinders and/or high rpms. Under those conditions, the interrupts would have to be serviced even more frequently and would further result in an excessive amount of time being taken away from that normally is available for the execution of the main program loop.

Figure 2:
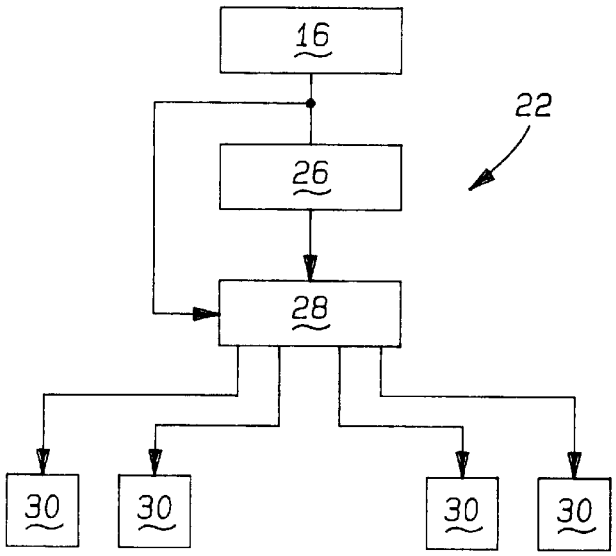
FIG. 2 is a flow diagram showing the general steps involved with the present invention.
Figure 3:
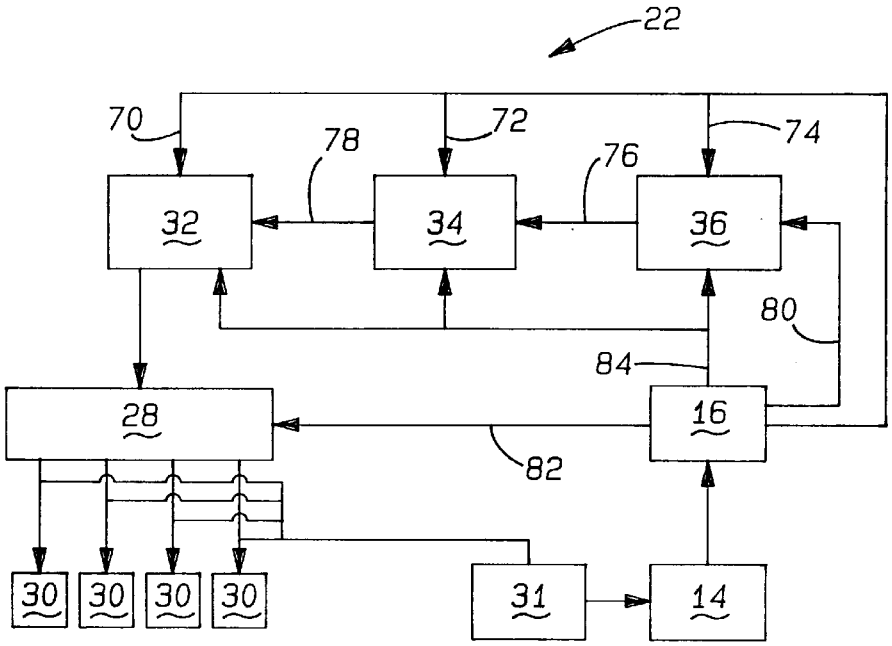
FIG. 3 is a circuit diagram of the coil-on-plug control circuit utilized in the present invention.

The obstacles mentioned above with respect to having the MP 16 directly generate multi-firings for ignition and/or for knock detection duty-cycling can be overcome with the method and circuit 22 generally outlined and illustrated in FIGS. 2 and 3. With the addition of this method and circuit 22, the MP 16 loads the circuit 22 with the required timing information for ignition or knock detection. The circuit 22 then generates the required multi-firing or knock detection control signals without requiring any further attention from the MP 16. Interrupt loading is therefore not increased over a distributor system and interrupt timing conflicts are eliminated while still achieving the desired programmability of the multi-firing feature.

FIG. 2 is a conceptual model showing the method of the coil-on-plug control circuit 22 for a four cylinder application. As will be apparent from the following description, the circuit 22 is readily modifiable for other engine applications.

The circuit has two main elements, a timing element 26 and a distribution element 28. The timing element 26, which includes three individual timers 32, 34 and 36, is loaded with the following information, based on the various engine parameters and engine timing signals, from the MP 16: a timing delay before which the coil control signals are to be generated; coil on-time; coil off-time; and the number of times this signal is to be repeated.

The distribution element 28 receives the coil control signal from the timing element 26 and distributes it to the appropriate capacitive discharge transformer 30 which is part of the coil-on-plug ignition system mounted to the spark plug (not shown). The distributor element 28 is also connected to and is programmed by the MP 16 to distribute the coil control signal from the timing element 26 to the appropriate transformer 30 and, therefore the appropriate cylinder. In this manner, if a cylinder is determined to be experiencing auto-ignition as further set out below, the controller 14 and MP 16 can be programmed to take the appropriate actions to stop the auto-ignition. One technical implementation of the method illustrated in FIG. 2, as employed in testing by the Assignee of the present invention, is shown in FIG. 3.

The following discussion is a description of the operation of the present invention for one complete combustion event in a given cylinder. Upon "key-on" of the automobile (not shown), the MP 16 initially configures the operating modes of the three timers 32, 34 and 36 in the timing element 26 via lines 70, 72 and 74 respectively. The first timer 32 is configured to operate in a continuous mode, meaning that it will keep repeating a series of programmed on-time and off-time signals while it is enabled. The second timer 34 is configured in a one-shot mode, meaning that it will countdown once, produce its signal, and then stop until it is retriggered. The third timer 36 is also configured to operate in a one-shot mode. The three timers 32, 34 and 36 are set up so that the MP 16 initially triggers the third timer 36 through line 80, which in turn triggers the second timer 34 through line 76, which in turn enables the first timer 36 through line 78.

Once the engine 10 is turning, the engine position signal from the flywheel pick-up 12 initiates an interrupt in the MP 16. The interrupt causes the MP 16 to compute time intervals, which are loaded into the timers 32, 34 and 36, for the appropriate firing of the spark plug. Additionally, the MP 16 provides a distribution signal to the distribution element 28 through line 80 indicating which transformer 30 and cylinder are to receive the firing signals. These time intervals and the actual number of multi-firings are based on the various engine parameters, also being monitored by the engine control system, including manifold pressure, coolant temperature, rpm, change in throttle position and others. The first timer 32 is loaded with the correct on-time/off-time for the coil control signal pulse train that will cause the multiple refirings of the spark plug during the initiation of the combustion cycle. The second timer 34 is loaded with the time period through which the first timer 32 is to be allowed to output its pulse train. This effectively programs the number of refirings which will occur at the spark plug during the initiating of the combustion cycle. The third timer 36 is loaded so that it will time-out at the instant it is desired to begin firing the spark plug (i.e., at the correct spark advance). All of the timers 32, 34 and 36 operate off of the MP's clock via line 82.

When it times out, the third timer 36 triggers the second timer 34. The second timer 34, immediately upon being triggered, outputs a signal which enables the first timer 32 thereby starting the first timer to output the multi-firing control signals. The multi-firing control signals are fed through the distribution element 28 to the appropriate transformer 30 until the second timer 34 has timed out and the programmed number of refirings have occurred.

Figure 4:
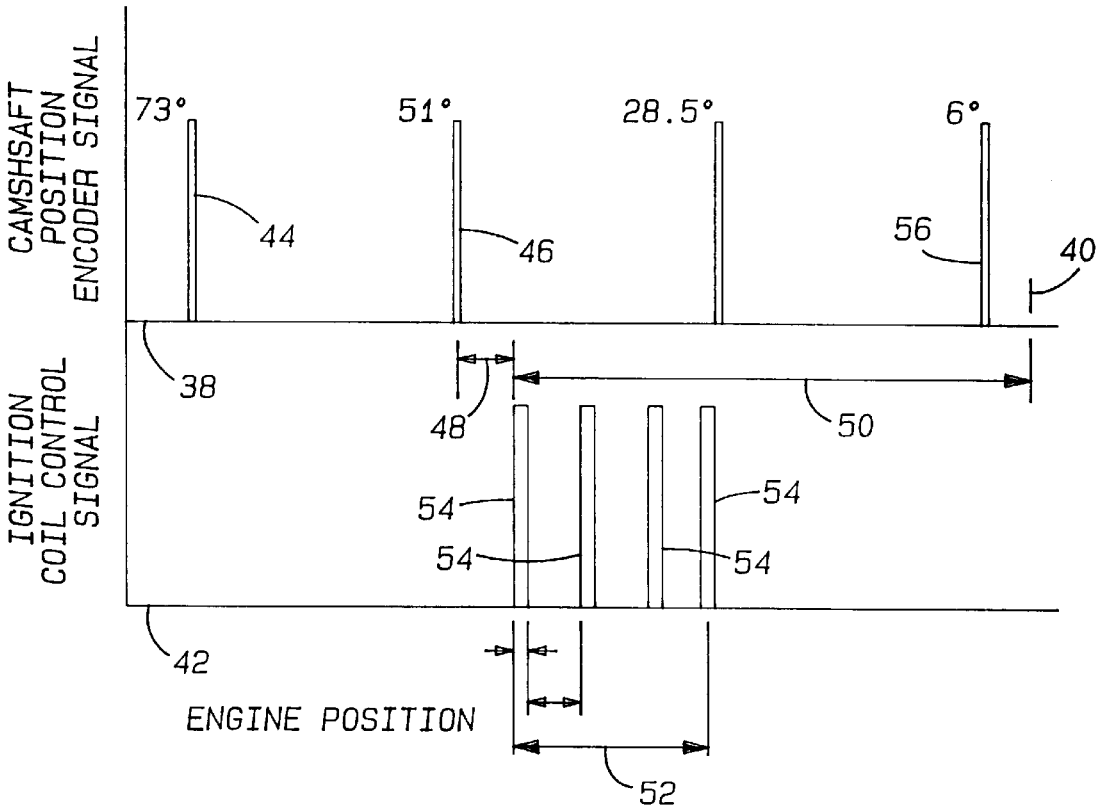
FIG. 4 is a diagrammatic illustration of the control signals for multi-firing a coil-on-plug ignition coil.

Referring now to FIG. 4, the multi-firing signals for a coil-on-plug ignition transformer 30 are shown for one combustion cycle of a cylinder in an internal combustion engine 10. The upper line 38 of the figure represents the camshaft position encoder signal before top dead center (BTDC). Top dead center (TDC) is generally designated at 40. The lower line 42 of the figure represents the ignition coil control signal from the first timer 32 for a total of four refiring.

By way of illustration and not limitation, the sequence of events for ignition of a given spark plug generally begins when the 73 degree flywheel pulse, designated at 44, initiated by the pick-up 12 triggers an interrupt in the MP 16 causing the correct number of counts to be loaded into the timers 32, 34 and 36 of the coil-on-plug control circuit 22 based on the various engine parameters mentioned above. The count-down or third timer 36 is loaded to create a time delay 46 from the next flywheel pulse, the 51° flywheel pulse generally designated at 48. This delay 46 times-out at the instant corresponding to the proper spark advance 50 for that particular firing of the spark plug. The timing-out of the third timer 36 triggers the second or interval timer 34 which controls the time-interval through which the multi-strikes or refirings are allowed to occur. This time-interval is generally designated 52. When the second timer 34 is triggered, it immediately enables the first or output timer 32 which begins to output a series of programmed pulses 54 representing the on-time and off-time for initial and repetitive firings of the coil driver 30. The pulses 54 continue to repeat until the second timer 34 times-out after approximately 300–400 microseconds. Once the second timer 34 has timed-out, the first timer 32 is disabled and the signals for multi-firing stop.

Figure 5:
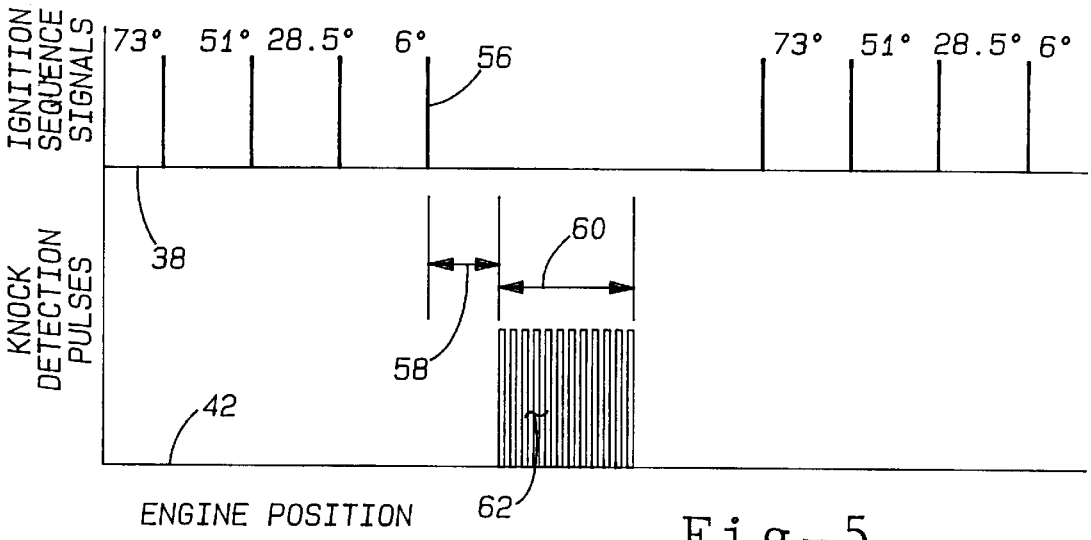
FIG. 5 is a diagrammatic illustration of the coil control signals for knock detection.

With the combustion cycle in process, it is possible to monitor for the occurrence of knock. The present invention uses an interrupt triggered by the 6 degree flywheel pick-up pulse, designated at 56, to prepare for the sampling of knock. This interrupt causes the MP 16 to computes the "coil-on" and "coil-off" times for duty-cycling the coil 30 during knock detection. These timing signals are loaded into the first timer 32. FIG. 5 generally shows the control signals produced during knock detection.

When detecting whether knock is occurring or not, the 6 degree flywheel pulse 56 triggers an MP interrupt which loads the correct number of counts, again based on the various engine parameters, into the timers 32, 34 and 36 of the coil-on-plug circuit 22. The third timer 36 again creates a time delay 58 from the flywheel 6 degree pulse that times-out at the correct instant to begin sampling for knock. The timing-out of the third timer 36 triggers the second timer 34 which controls the time-interval 60 through which duty-cycling is allowed to occur. Similar to that done during the initiation of combustion, the second timer 34 enables the first timer 32 which then outputs the programmed duty-cycle which consists of a series of pulses 62 at an appropriate frequency for detecting knock. This sampling for knock continues until the second timer 34 times-out, approximately after 200–400 microseconds.

The signals that are loaded into the timers 32, 34 and 36 in the coil-on-plug control circuit 22 for knock detection are also computed by the MP 16. In so doing, the MP 16 determines the time period where sampling for knock will begin, the time window through which sampling for knock will occur, and the frequency and voltage at which the transformer 30 will be cycled. As mentioned above, these intervals are computed as a function of engine parameters including, manifold absolute pressure, coolant and charge temperature. The voltage generated at the transformer 30 during knock detection is typically less than that utilized during the initiation of the combustion process.

Figure 6:
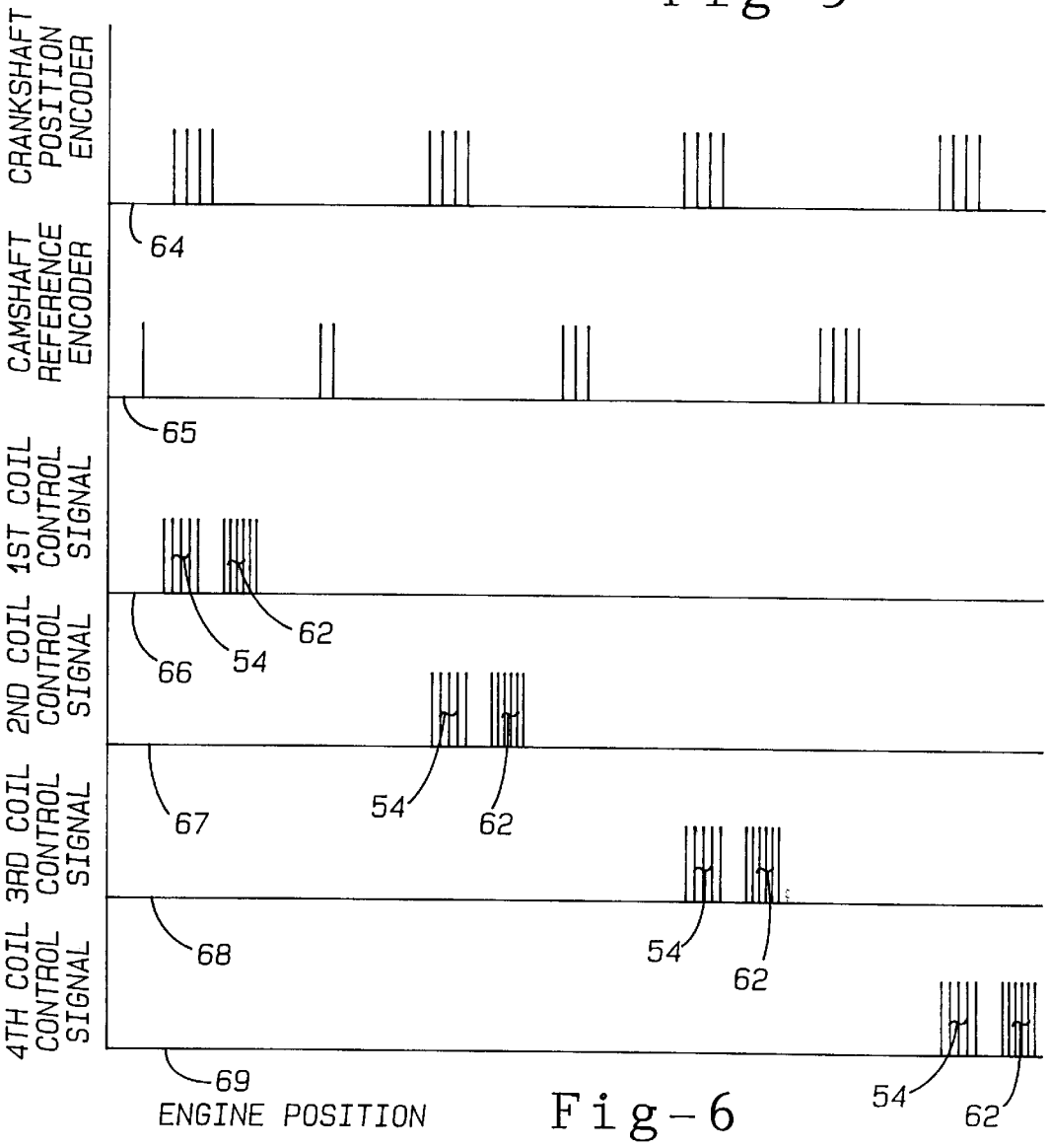
FIG. 6 is a diagrammatic illustration of both the control signal for multi-firing of a coil-on-plug ignition coil and the coil control signals for knock detection in a four cylinder engine.

FIG. 6 shows the combined control signals produced by the circuit 22 for programmed multi-firing during ignition and for programmed duty-cycling during knock detection in a four cylinder engine application. The crankshaft position encoder 64, camshaft/cylinder reference encoder 65, as well as the coil control signals for the first coil 66, second coil 67, third coil 68 and fourth coil 69, are also designated in the figure.

As mentioned above, if the cylinder is experiencing auto-ignition, rapid pressure and temperature fluctuation will be occurring in the cylinder. Since the fluctuating temperature and pressure conditions occurring during auto-ignition relate to a breakdown voltage which at times will be-momentarily less than the breakdown voltage at the same corresponding engine position under normal combustion conditions, a spark discharge during that period of the engine cycle can be made to occur during auto-ignition conditions and not during normal combustion conditions.

By providing a sensor circuit 31 which is capable of detecting the existence of the breakdown current, and therefore the occurrence of a discharge indicating auto-ignition, it is possible to monitor for the occurrence of auto-ignition. The sensor circuit 31 signals the controller 14 which takes appropriate measures to correct and eliminate the occurrence of auto-ignition, stepping the ignition timing toward incipient auto-ignition.

While the above description constitutes the preferred embodiments of the present invention, it will be appreciated that the invention is susceptible to modification, variation and change without departing from the proper scope and fair meaning of the accompanying claims.

I claim:

1. An ignition system including a battery and adapted for multi-firing a spark plug of a spark ignition internal combustion engine, said ignition system comprising:

a DC/DC converter which steps up battery voltage provided by the battery;

at least one coil-on-plug transformer having a primary winding and a secondary winding, said secondary winding being connected to a spark plug;

a distribution element coupled to said DC/DC converter and to said transformer, said distribution element supplying a voltage signal from said DC/DC converter to said primary winding producing a high voltage signal at said secondary winding of said transformer applied to the spark plug;

a timing element coupled to said distribution element, said timing element including a first timer, a second timer and a third timer, said third timer being configured as a count-down timer to time-out at a predetermined number of degrees of engine rotation and trigger said second timer, said second timer being configured as a count-down timer to enable said first timer when triggered by said third timer, said first timer configured to continuously operate producing a series of predetermined control signals to said distribution element when enabled by said second timer thereby enabling said distribution means to generate said high voltage signal at said secondary of said transformer and applied to the spark plug, said second timer disabling said first timer and terminating said series of predetermined control signals when said second timer times-out;

control means for providing control signals to said timing element and for providing a distribution signal to said distribution element, said control signals determining a repetitive time-on time-off cycle for said first timer, a durational period between which said second timer enables and disables said first timer and a dwell period causing said third timer to time-out at said predetermined number of degrees of engine rotation, said distribution signal determining said transformer to which said voltage signal is supplied; and timing means for sensing engine position and providing a position signal to said control means which corresponds to engine position.

2. An ignition system as set forth in claim 1 further comprising discharge detection means for sensing the occurrence of an electrical discharge across the spark plug as a result of said high voltage signal applied to the spark plug, said detection means producing and providing a discharge signal to said control means corresponding to the occurrence of electrical discharge across the spark plug and thereby enabling said control means to appropriately respond to said occurrence of electrical discharge.

3. An ignition system as set forth in claim 2 wherein said detection means senses the occurrence of an electrical discharge across the spark plug indicating the existence of auto-ignition characterized by pressure and temperature fluctuations within the engine combustion chamber after piston top-dead-center which depart from normal combustion pressure and temperature conditions within the engine combustion chamber.

4. An ignition system as set forth in claim 3 wherein said distribution element produces said voltage signals in response to said series of predetermined control signals at a level which discharges during auto-ignition within the combustion chamber and which fails to discharge during normal combustion within the combustion chamber.

5. An ignition system as set forth in claim 1 wherein said series of predetermined control signals are continuously produced while said second timer is enabled.

6. An ignition system as set forth in claim 1 further comprising a plurality of coil-on-plug transformers each being connected to a spark plug.

7. An ignition system as set forth in claim 6 wherein said distribution element is coupled to said plurality of transformers, said distribution signal determining which of said plurality of transformers is to receive said voltage signal.

8. An ignition system as set forth in claim 1 wherein said transformer is a pulse transformer.

9. An ignition system as set forth in claim 1 wherein said DC/DC converter steps up the battery voltage to at least 200 volts.

10. A method for applying multiple high voltage signals to a spark plug of a spark ignition internal combustion engine utilizing an ignition system having a controller, a timing element including at least three timers, a distribution element, a coil-on-plug transformer, and an engine position sensor, said method comprising the steps of:

sensing the position of the engine;

providing a position signal to the controller;

calculating appropriate timing signals based on engine parameters;

loading the timing signals into the timing element;

triggering a third timer of the timing element to count-down to a predetermined engine position of the combustion cycle;

timing-out the third timer at said predetermined engine position;

triggering a second timer of the timing element at the timing-out of the third timer;

enabling a first timer of the timing element by the triggering of the second timer, the first timer outputting a continuous series of control signals to the distribution element when enabled;

distributing the series of control signals to the transformer;

applying a series of high voltage pulses from the transformer to the spark plug at the predetermined engine position of the combustion cycle;

timing-out the second timer; and disabling the first timer at the timing-out of the second timer.

11. The method of claim 10 wherein said loading step further comprises the steps of:

configuring the first timer to continuously produce a series of time-on time-off signals of a predetermined period when enabled;

configuring the second timer to operate as a count-down timer and for a predetermined number of counts; and configuring the third timer to operate as a count-down timer and for a predetermined number of counts.

12. The method of claim 10 wherein said step of loading the timing signals into the timing element further comprises the steps of:

loading the first timer with a multi-firing duty cycle based on the engine parameters;

loading the second timer with a time interval through which the duty cycle of the first timer is to be permitted to occur and output its signals; and loading the third timer with a time interval causing the third timer to time-out at the predetermined number of degrees of engine position to initiate the sequence for multi-firing the spark plug.

13. The method of claim 10 wherein said third timer counts down to said predetermined engine position which corresponds to a desired spark advance for initiating combustion.

14. The method of claim 13 further comprising the step of initiating combustion within the combustion cylinder.

15. The method of claim 10 wherein said predetermined engine position corresponds to a portion of the combustion cycle in which auto-ignition is likely to occur.

16. A method for applying multiple high voltage signals to a spark plug of a spark ignition internal combustion engine and utilizing an ignition system to detect the occurrence of auto-ignition in a combustion chamber of the engine, the ignition system including a controller, a timing element having a first timer, a second timer and a third timer, a DC/DC converter, a distribution element, a pulse transformer, an engine position sensor and a discharge circuit, said method comprising the steps of:

sensing engine position and providing a position signal to the controller;

determining appropriate timing signals to be used in detecting auto-ignition based on engine parameters;

loading the timing signals into the timing element;

triggering the third timer of said timing element to begin a count-down sequence;

timing-out the third timer at an engine position which corresponds to that portion of the combustion cycle where auto-ignition is likely to occur;

triggering the second timer at the timing-out of the third timer;

enabling the first timer at the triggering of the second timer, the first timer outputting a continuous series of controls signals to the distribution element;

distributing the series of voltage signals from the DC/DC converter and corresponding to the control signals to the transformer;

applying a series of high voltage pulses to the spark plug from the transformer during that portion of the combustion cycle where auto-ignition is likely to occur;

monitoring the spark plug for the discharging of at least one high voltage pulse of the series of high voltage pulses across the spark plug;

signaling the controller upon the detection of the discharging of at least one high voltage pulse across the spark plug;

timing-out the second timer; and disabling the first timer at the timing-out of the second timer.

17. The method set forth in claim 16 wherein said monitoring step includes the step of sensing the occurrence of an electrical discharge of at least one high voltage pulse across the spark plug indicating the occurrence of auto-ignition in the combustion chamber, auto-ignition being characterized after the piston top-dead-centers by pressure and temperature fluctuations within the combustion chamber which depart from normal combustion pressure and temperature conditions within the combustion chamber.

18. The method set forth in claim 16 wherein the detection circuit detects discharging of at least one high voltage pulse when the combustion chamber is experiencing auto-ignition and fails to detect discharging of at least one high voltage pulse when the combustion chamber is experiencing normal combustion.

19. The method of claim 16 wherein said loading step further comprises the steps of:

configuring the first timer to continuously produce a series of time-on time-off signals when enabled;

configuring the second timer to operate as a count-down timer; and configuring the third timer to operate as a count-down timer.

20. The method of claim 16 wherein said step of loading the timing signals into the timing element further comprises the steps of:

loading the second timer with a time interval through which the duty cycle of the first timer is to be permitted to occur and output its signals; and loading the third timer with a time interval causing the third timer to time-out at the predetermined number of degrees of engine position to initiate the sequence for multi-firing the spark plug.

* * * * *